US010886686B2

(12) United States Patent
Delescluse et al.

(10) Patent No.: US 10,886,686 B2
(45) Date of Patent: Jan. 5, 2021

(54) METHOD FOR CRIMPING AN ELECTRICAL CONTACT TO A CABLE AND TOOL FOR IMPLEMENTING SAID METHOD

(71) Applicant: Aptiv Technologies Limited, St. Michael (BB)

(72) Inventors: Laurent Delescluse, Luce (FR); Laurent Tristani, Margon (FR); Benoit Beaur, Chartres (FR)

(73) Assignee: APTIV TECHNOLOGIES LIMITED

( * ) Notice: Subject to any disclaimer, the term of this patent is extended or adjusted under 35 U.S.C. 154(b) by 98 days.

(21) Appl. No.: 15/554,593

(22) PCT Filed: Mar. 7, 2016

(86) PCT No.: PCT/EP2016/054804
§ 371 (c)(1),
(2) Date: Aug. 30, 2017

(87) PCT Pub. No.: WO2016/142345
PCT Pub. Date: Sep. 15, 2016

(65) Prior Publication Data

US 2018/0241167 A1 Aug. 23, 2018

(30) Foreign Application Priority Data

Mar. 6, 2015 (FR) ..... 15 51916

(51) Int. Cl.
*H01R 43/048* (2006.01)
*H01R 4/18* (2006.01)

(52) U.S. Cl.
CPC ..... *H01R 43/0488* (2013.01); *H01R 4/184* (2013.01); *H01R 4/185* (2013.01); *H01R 43/048* (2013.01)

(58) Field of Classification Search
CPC .. H01R 43/0488; H01R 43/048; H01R 4/184; H01R 4/185
See application file for complete search history.

(56) References Cited

U.S. PATENT DOCUMENTS 4,790,173 A * 12/1988 Boutcher, Jr. ..... B30B 15/0035 100/257
5,046,241 A * 9/1991 Ricard ..... B30B 15/0029 29/753
5,486,653 A * 1/1996 Dohi ..... H01R 4/185 174/84 C
6,230,406 B1 * 5/2001 Balfour ..... H01R 43/048 29/745

(Continued)

FOREIGN PATENT DOCUMENTS

WO WO-2008120048 A1 * 10/2008 ..... H01R 4/26
WO 2009/115860 A1 9/2009

*Primary Examiner* — Peter Dungba Vo
*Assistant Examiner* — Jeffrey T Carley
(74) *Attorney, Agent, or Firm* — Robert Myers; Billion & Armitage

(57) ABSTRACT

A method of attaching an electrical contact to a cable is presented herein. The electrical contact is crimped to the cable, at different heights, in such a way as to obtain a mechanical retention portion and an electrical conduction portion. The difference between the final crimping heights of the mechanical retention portion and the electrical conduction portion is between 0.5 and 0.6 mm. A tool for implementing this method is also described herein.

8 Claims, 2 Drawing Sheets

(56) References Cited

U.S. PATENT DOCUMENTS

| | | | | |
|---|---|---|---|---|
| 7,306,495 | B2 | 12/2007 | Hashimoto et al. | |
| 2001/0023152 | A1* | 9/2001 | Tachi | H01R 13/04 439/733.1 |
| 2005/0124231 | A1* | 6/2005 | Okamoto | H01R 4/184 439/851 |
| 2007/0054565 | A1* | 3/2007 | Courtin | H01R 43/0488 439/851 |
| 2007/0202726 | A1* | 8/2007 | Lee | H01R 9/0518 439/188 |
| 2010/0105256 | A1* | 4/2010 | Lyford | H01R 4/20 439/877 |
| 2010/0120288 | A1* | 5/2010 | Drew | H01R 4/18 439/585 |
| 2010/0230160 | A1* | 9/2010 | Ono | H01R 4/185 174/84 C |
| 2011/0021092 | A1* | 1/2011 | Ukai | H01R 4/185 439/877 |
| 2013/0040509 | A1* | 2/2013 | Mitose | H01R 4/185 439/877 |
| 2013/0199842 | A1* | 8/2013 | Inoue | H01R 4/70 174/84 C |
| 2013/0231012 | A1* | 9/2013 | Lengert | H01R 4/184 439/877 |
| 2014/0302726 | A1* | 10/2014 | Adachi | H01R 4/18 439/877 |
| 2015/0140856 | A1* | 5/2015 | Sato | H01R 4/183 439/523 |
| 2015/0140874 | A1* | 5/2015 | Sakaguchi | H01R 4/185 439/879 |
| 2015/0264800 | A1* | 9/2015 | Schmalbuch | H01R 43/0235 174/257 |

* cited by examiner

METHOD FOR CRIMPING AN ELECTRICAL CONTACT TO A CABLE AND TOOL FOR IMPLEMENTING SAID METHOD

CROSS-REFERENCE TO RELATED APPLICATIONS

This application is a national stage application under 35 U.S.C. § 371 of PCT Application Number PCT/EP2016/054804 having an international filing date of Nov. 10, 2015, which designated the United States, said PCT application claiming the benefit of French Patent Application No. 1551916 (now French Patent No. 3033450), filed Mar. 6, 2015, the entire disclosure of each of which are hereby incorporated herein by reference.

TECHNICAL FIELD OF THE INVENTION

The invention concerns the field of electrical connections. In particular, the invention concerns a method of crimping an electrical contact to an electrical cable, an electrical contact crimped with this method, as well as a tool for implementing this method.

BACKGROUND OF THE INVENTION

In connection techniques, one uses the coupling of male and female electrical contacts to make an electrical connection between cable connectors or between a cable connector and an electrical or electronic device, for example. In the case of a cable connector, male or female contacts are electrically joined, by welding, crimping or another technique, to a cable comprising one or more strands.

In automotive connections, the contacts are often made by stamping and bending a copper sheet. The cables are generally also made of copper.

To reduce the weight of the electrical harnesses in vehicles in particular, the copper cables are sometimes replaced by aluminum cables comprising several conductor strands. The replacement of copper cables by aluminum cables presents several problems. Primarily, the aluminum being covered by an oxide layer, the electrical conduction in the area of the contact zones between an aluminum cable and a copper contact may be reduced. In order to mitigate this problem, on the one hand one tries to break up the oxide layer in order to have better conductivity and, on the other hand, to prevent the reforming of this oxide layer after crimping. To this end, one may increase the level of compression of the cable in the crimping zone. But this increasing of the level of compression causes a reduced mechanical strength of the cable in the zone so compressed.

Document U.S. Pat. No. 7,306,495B2 proposes a method of crimping in which one provides:

- an electrical cable having a plurality of conductor strands made of aluminum, and
- an electrical contact with a crimping zone extending in a longitudinal direction and comprising a base and two fins extending on either side of the base to form a groove having basically a U shape in cross section in a plane perpendicular to the longitudinal direction.

In this method, one furthermore performs a crimping of the crimping zone to the cable by bending and compressing the fins onto the cable. To this end, one uses a tool comprising a punch having two different crimping heights. One thus obtains a crimping zone which, after the crimping, itself comprises a mechanical retention portion and an electrical conduction portion. The mechanical retention and electrical conduction portions are continuous in material with each other. In other words, starting from a contact with a single fin on either side of the cable, without cutting off these fins or slitting them to separate them into several portions, one obtains a continuous crimping shaft in the longitudinal direction. The mechanical retention and electrical conduction portions have different final crimping heights, the final crimping height of the mechanical retention portion being higher than the final crimping height of the electrical conduction portion.

Thus, in the mechanical retention zone, the strands of the cable are less compressed (the level of compression is for example between 20 and 30%), and so the integrity of their mechanical properties is essentially preserved and the retention of the cable in the crimping shaft meets the specifications. For example, for a copper wire of 1.5 $mm^2$, this retention force should be greater than 155 N. In the electrical conduction zone, the strands of the cable are more compressed (the level of compression is for example between 50 and 65%), the mechanical properties there are thus degraded as compared to the mechanical retention zone. On the other hand, the electrical resistivity in the electrical conduction zone is less than in the mechanical retention zone.

However, one may observe, in certain cases, that the electrical and mechanical properties of contacts crimped with this type of method degrade over time.

BRIEF SUMMARY OF THE INVENTION

One purpose of the invention is to mitigate at least in part this drawback.

To this end, a method is provided of crimping an electrical contact, as mentioned above, in which furthermore the difference between the final crimping heights of the mechanical retention portion and the electrical conduction portion is between 0.4 and 0.7 mm, or less, and between 0.5 and 0.6 mm in certain cases.

Thanks to this arrangement (which may result for example from the geometry of the crimping punch), the deformations of the contact in the transition zone between the mechanical retention portion and the electrical conduction portion are limited and the contact has no crack or tear. Furthermore, if the copper contact is covered by a protection layer, for example of tin, the integrity of the latter remains intact. One may thus avoid problems of electrolytic corrosion due to electrochemical potential differences between the cable and the contact.

One may furthermore provide one or another of the following characteristics, considered alone or in combination with one or more others:

- the crimping is done by compressing the fins in the area of the electrical conduction portion for a distance, in the longitudinal direction (when the contact is positioned in the crimping tool comprising the punch), greater than or equal to 1.5 mm; and
- the crimping is done by compressing the fins in the area of the electrical conduction portion and in the area of the mechanical retention portion at constant heights over their respective length in the longitudinal direction, and with a transition zone between the electrical conduction portion and the mechanical retention portion whose dimension in the longitudinal direction (when the contact is positioned in the crimping tool comprising the punch) is between 0.3 mm and 0.6 mm.

According to another aspect, the invention concerns an electrical contact crimped with the aforementioned method. This contact comprises a run between the mechanical retention portion and the electrical conduction portion whose height is between 0.4 and 0.7 mm, or less, and between 0.5 and 0.6 mm in certain cases.

One may moreover provide for this contact one or another of the following characteristics, considered alone or in combination with one or more others:

- the run has a rounded internal bending with a radius of curvature between 0.1 mm and 0.5 mm;
- the run has a rounded external bending with a radius of curvature between 0.1 mm and 0.5 mm;
- the sum of the radii of curvature of the internal bending and the external bending is between 0.3 and 0.5 mm; and
- the radius of curvature of the internal folding is between 0.1 mm and 0.2 mm, for example being equal to 0.1 mm, and that of the external folding is between 0.1 mm and 0.4 mm, for example being equal to 0.2 mm.

According to another aspect, the invention concerns a tool comprising a crimping punch for implementing a method of crimping an electrical contact. This punch comprises a groove having substantially a W shape in cross section in a plane perpendicular to the longitudinal direction. This groove has two successive segments in the longitudinal direction, a deeper segment to compress the fins in the area of the mechanical retention portion and a less deep segment to compress the fins in the area of the electrical conduction portion, the height difference between these two segments being between 0.4 and 0.7 mm, or less, and between 0.5 and 0.6 mm in certain cases.

One may moreover provide for this contact one or another of the following characteristics, considered alone or in combination with one or more others:

- the segment compressing the fins in the area of the electrical conduction portion has a dimension in the longitudinal direction greater than or equal to 1.5 mm;
- the height difference between the two segments forms a run whose run edge has a radius of curvature between 0.1 mm and 0.5 mm;
- the bottom of the run is rounded with a radius of curvature between 0.1 mm and 0.5 mm;
- the sum of the radii of curvature of the run edge and the run bottom is between 0.3 and 0.5 mm; and
- the radius of curvature of the run edge is equal to 0.1 mm and that of the run bottom is equal to 0.2 mm.

BRIEF DESCRIPTION OF THE SEVERAL VIEWS OF THE DRAWING

Other characteristics and advantages of the invention shall appear upon reading the detailed description and the appended drawings, in which.

In these figures, the same references are used to designate identical or similar elements.

DETAILED DESCRIPTION OF THE INVENTION

Figure 1:
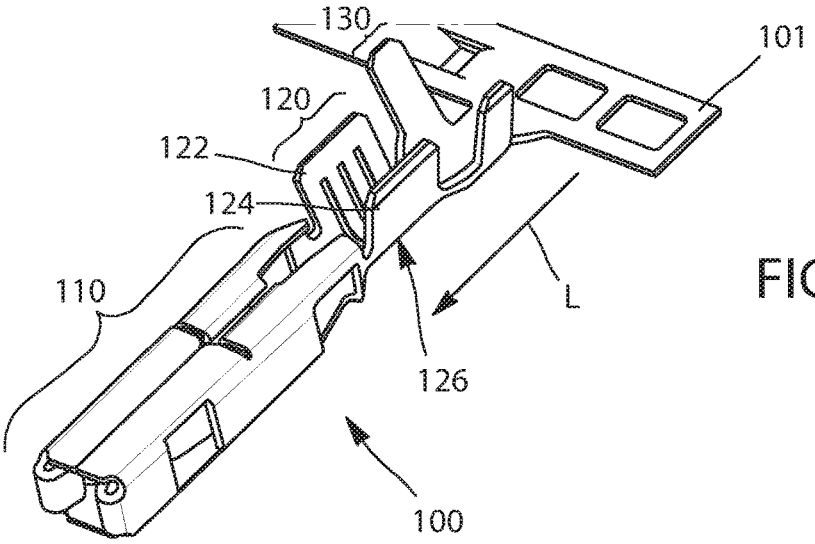
FIG. 1 represents schematically in perspective view an example of a contact which has not yet been crimped to a cable.

FIG. 1 shows an electrical contact 100 designed to be mounted in a connector cavity (not shown) of a motor vehicle. The electrical contact 100 is realized for example by stamping and bending of a copper sheet. The thickness of this copper sheet is for example between 0.2 and 0.5 mm. In the case depicted, it is a straight female electrical contact, extending in a longitudinal direction L which also corresponds to the coupling direction. In other cases, not represented, the electrical contact 100 may be a right-angled contact, for example. The electrical contact 100 is represented here attached to a bearing band 101, from which the electrical contact 100 will be disassociated at a later stage, after a possible tin plating.

Figure 2:
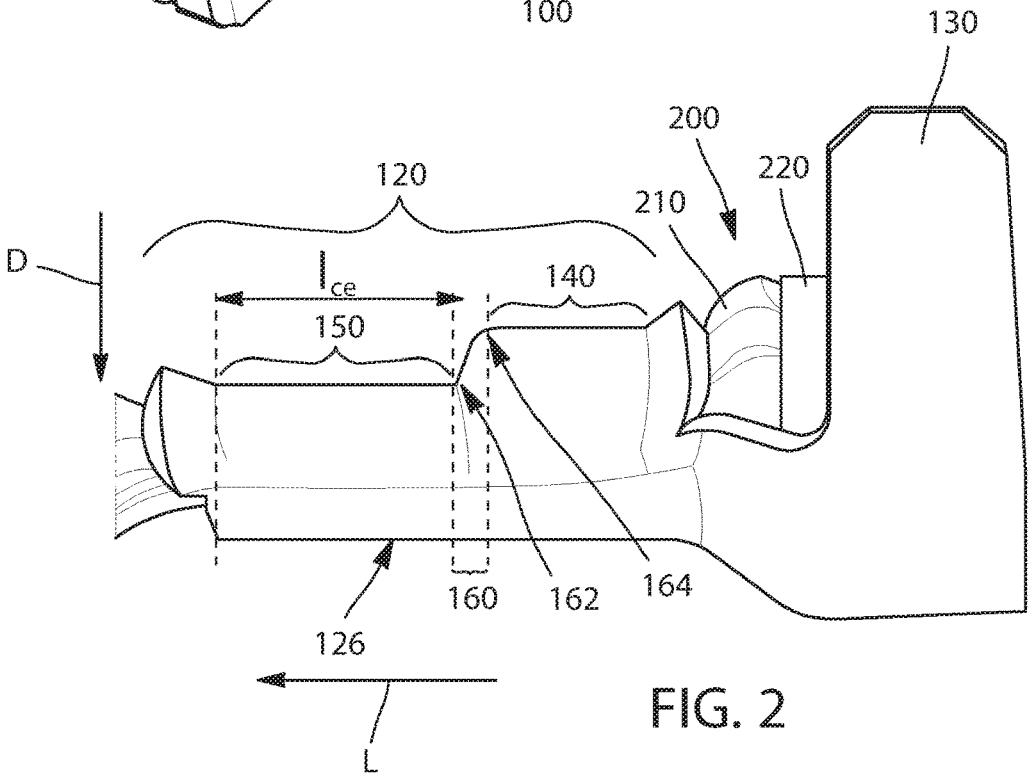
FIG. 2 represents in lateral elevation view the crimping zone of the contact of FIG. 1 after crimping its crimping fins to a cable.

The electrical contact 100 has a coupling portion 110, a crimping zone 120 against the conductor strands 210 of a cable 200 and a crimping end 130 against the insulator 220 of this cable 200 (see FIG. 2). In the case represented in FIG. 1, the coupling portion 110, the crimping zone 120 and the crimping end 130 succeed one another along the longitudinal direction L, which also corresponds to the coupling direction. In the case of a right-angled contact, the coupling portion 110 might be perpendicular to the crimping zone 120 and the crimping end 130 which themselves extend along the longitudinal direction L. But, even if the following description involves a straight contact, the skilled person could easily perform a transposition of it for a right-angled or another contact.

Prior to crimping, the crimping zone 120 is present in the form of a gutter with two fins 122, 124 extending on either side of a base 126. The two fins 122, 124 and the base 126 thus form, prior to crimping, a groove having basically a U-shaped cross section in a plane perpendicular to the longitudinal direction L. Each of the two fins 122, 124 is continuous for its entire length. In other words, the two fins 122, 124 have neither a slit nor a cut.

The electrical contact 100 undergoes a step of crimping onto a cable 200 during which the two fins 122, 124 are bent and compressed against a bare portion of cable 200. This crimping step is done by inserting the end of the cable 200 into the respective grooves of the crimping zone 120 and the crimping end 130 and striking the electrical contact 100, in the area of the crimping zone 120, between an anvil (not shown) of a type known to the skilled person and a punch 300, which shall be described below.

As represented in FIG. 2, after this step of crimping to the strands of the portion of the cable 200 having the insulator 220 stripped off, the crimping zone 120 has a mechanical retention portion 140, an electrical conduction portion 150, and a transition zone 160 between the two. The mechanical retention portion 140, the electrical conduction portion 150 and the transition zone 160 are continuous in material with each other, with no slit or cut in the longitudinal direction L.

The mechanical retention portion 140 and electrical conduction portion 150 have final crimping heights which are different in a direction perpendicular to the longitudinal direction L and correspond to the direction D of displacement of the punch 300 toward the anvil and each other. The final crimping height of the mechanical retention portion 140 (also see FIG. 3B) is not as tall as the final crimping height of the electrical conduction portion 150 (also see FIG. 3A).

The heights of the mechanical retention portion 140 and the electrical conduction portion 150 are each substantially constant for their respective length. Thus, the height difference is substantially fixed and may be between 0.5 mm and 0.6 mm, for a thickness of copper sheet between 0.20 and 0.39 mm and for an aluminum cable whose diameter is between 1.25 and 4 mm, or even between 0.75 and 6 mm. This height difference is enough to obtain very different levels of compression respectively in the mechanical retention portion 140 and the electrical conduction portion 150 while avoiding the creation of a crack or a tear in the sheet forming the electrical contact 100. This is particularly important when the copper is tin plated. In fact, a tear or a crack in the tin-plated copper layer would expose the underlying copper and thus in the long term cause electrochemical corrosion effects, making the contact mechanically brittle and degrading its conduction, especially in the area of the contact/cable interface.

Figure 3A:
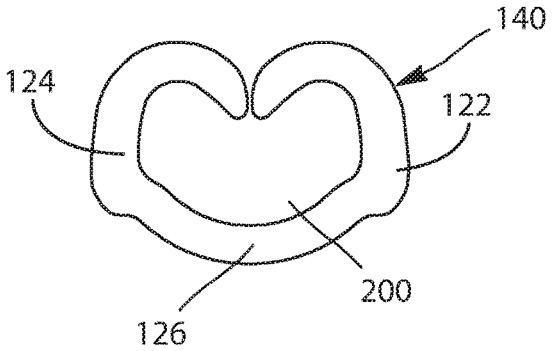
FIGS. 3A and 3B represent two transverse sections of the crimping zone of the contact of FIG. 2, one of these sections being made in the area of the mechanical retention portion and the other of these sections being made in the area of the electrical conduction portion.

One defines the level of compression as being the ratio between the cross section of the cable 200 after crimping and the cross section of the cable 200 prior to crimping. One may then determine, by comparing the cross sections of the electrical contact 100, and thus the cross sections of the cable 200, respectively represented in FIGS. 3A and 3B, that the level of compression of the cable 200 is greater in the area of the electrical conduction portion 150 (FIG. 3B) than in the area of the mechanical retention portion 140 (FIG. 3A). For example, to obtain a good electrical resistance between the electrical contact 100 and the cable 200, the level of compression in the area of the electrical conduction portion 150 is advantageously of the order of 50% or more (up to 65%) and the level of compression in the area of the mechanical retention portion 140 is between 20 and 30%.

In the example described here, the length $l_{ce}$ (that is, in the longitudinal direction L) of the electrical conduction portion 150 is greater than 1.5 mm. It has been discovered by the inventors that, with a length $l_{ce}$ less than 1.4 mm, the electrical resistance of the crimping is greater than 0.3 mΩ and evolves over time, regardless of the level of compression in the area of the electrical conduction portion 150. It has also been discovered by the inventors that, with a level of compression in the area of the electrical conduction portion 150 less than 50%, the electrical resistance of the crimping is greater than 0.3 mΩ and evolves over time, regardless of the length $l_{ce}$. On the other hand, with a length $l_{ce}$ greater than 1.4 mm and a level of compression in the electrical conduction portion 150 greater than 50%, one obtains a resistance in the area of the electrical conduction portion 150 of less than 0.3 Mω that is stable over time.

Returning to FIG. 2, the dimension of the transition zone 160 in the longitudinal direction L is between 0.3 mm and 0.6 mm. In the present case, it is 0.3 mm.

The height difference between the electrical conduction portion 150 and the mechanical retention portion 140 forms a run with an internal bending 162 and an external bending 164. The internal bending 162 and the external bending 164 are rounded with a radius of curvature between 0.1 mm and 0.5 mm. In the present case, the radius of curvature of the internal bending 162 is 0.1 mm and that of the external bending 164 is 0.2 mm. In this case, the sum of the radii of curvature of the internal bending 162 and the external bending 164 is thus 0.3 mm.

Figure 3B:
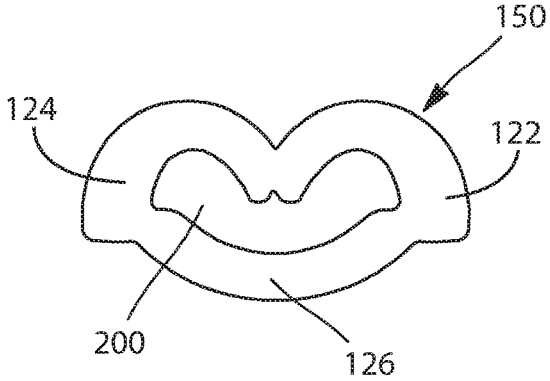
Figure 4:
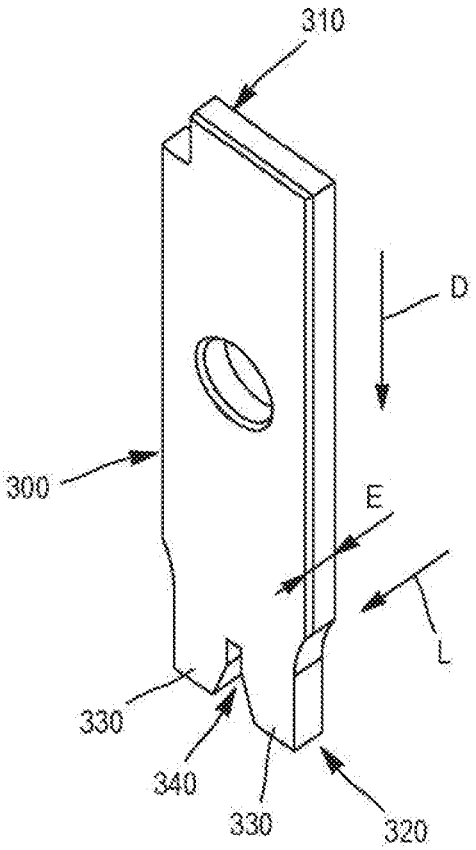
FIG. 4 represents schematically in perspective view a crimping tool.
Figure 5:
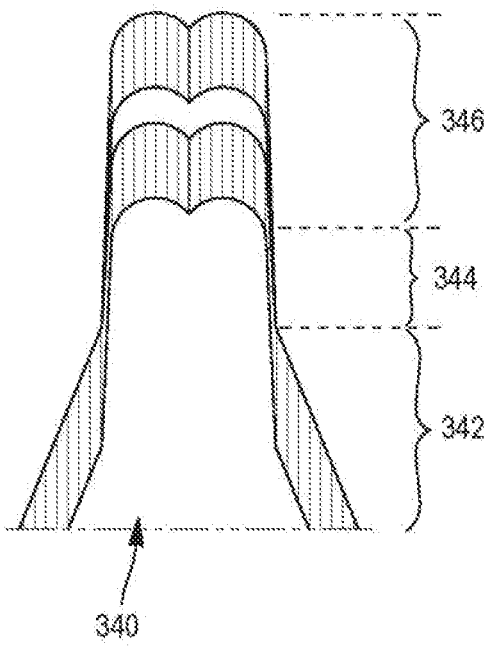
FIG. 5 represents schematically in perspective view a detail of the crimping tool of FIG. 4.
Figure 6:
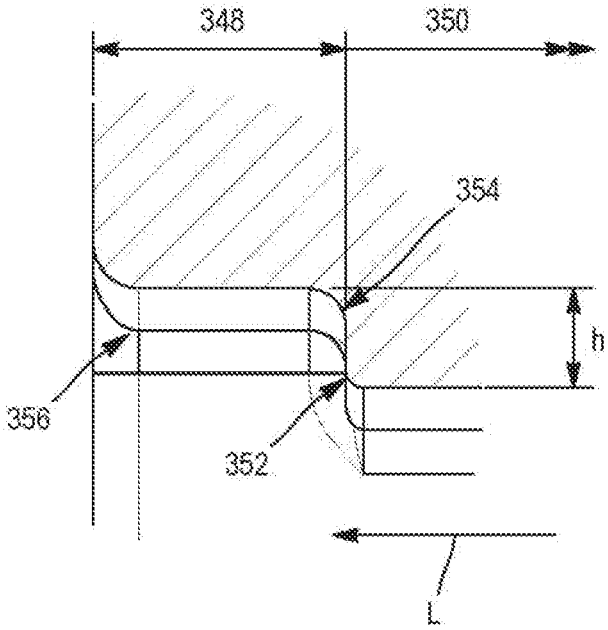
FIG. 6 represents schematically in cross section a detail of the crimping tool of FIGS. 4 and 5.

The electrical contact 100 illustrated in FIGS. 2, 3A and 3B is crimped with a tool comprising a punch 300, illustrated in FIGS. 4, 5, and 6.

This punch 300 has substantially the shape of a parallelepiped plate, elongated between a high end 310 and a low end 320, in the direction D of displacement of the punch 300 during the crimping (see FIG. 4). This plate has a thickness E in the direction corresponding to the longitudinal direction L during the crimping. The low end 320 has two teeth 330 separated by a notch 340.

As represented in FIG. 5, the notch 340 corresponds to the portion of the punch 300 making possible the forming of the two fins 122, 124 during the crimping. The notch 340 has a V-shaped mouth 342 making it possible to bring together the two fins 122, 124 as far as a position in which they are substantially parallel, then a channel 344 with walls substantially parallel to receive the two fins 122, 124 when they are parallel, and finally a groove 346 making it possible for the two fins 122, 124 to be brought progressively on top of the cable 200, toward it and then into it.

This groove 346 has substantially a W shape in cross section in a plane perpendicular to the longitudinal direction L. The groove 346 has two successive segments 348, 350 in the longitudinal direction L. The deepest segment 348 is the one which compresses the two fins 122, 124 in the area of the mechanical retention portion 140. The shallowest segment 350 is the one which compresses the two fins 122, 124 in the area of the electrical conduction portion 150. The height difference h between these two segments 348, 350 may be between 0.5 and 0.6 mm. In the example described here, this height difference h is 0.55 mm. The length of the shallowest segment 350 compressing the two fins 122, 124 in the area of the electrical conduction portion 150 has a dimension in the longitudinal direction which is greater than or equal to 1.4 mm. In the example described here, it is 1.5 mm.

The height difference h between the segments 348, 350 forms a run with a run edge 352 and a run bottom 354. The run edge 352 may have a radius of curvature between, for example, 0.1 mm and 0.5 mm. In the case described here, it is 0.1 mm. The bottom 354 of the run is likewise rounded. It may have a radius of curvature between, for example, 0.1 mm and 0.5 mm. In the case described here, it is 0.2 mm.

Furthermore, in order to prevent deterioration of any protective coating (such as tin) of the electrical contact 100, the ridge 356 of the groove 346 is likewise rounded with a radius of curvature between, for example, 0.15 and 0.4 mm.

The invention claimed is:

1. A method of crimping an electrical contact, comprising the steps of:

providing an electrical cable having a plurality of conductor strands made of aluminum;

providing the electrical contact with a coupling portion and a crimping zone arranged along a longitudinal coupling direction of the electrical contact, wherein the crimping zone comprises a base and two fins extending from the base to form a groove having a U shape in cross section in a plane perpendicular to the longitudinal coupling direction;

bending the two fins into contact with the plurality of conductor strands; and compressing the two fins, the two fins thereby forming a mechanical retention portion, an electrical conduction portion, and a transition zone arranged between the electrical conduction portion and the mechanical retention portion, the transition zone integrally formed with the mechanical retention portion and electrical conduction portion, wherein the mechanical retention portion, transition zone, and electrical conduction portion are arranged in sequence along the longitudinal coupling direction of the electrical contact, wherein a first final crimping height of the mechanical retention portion is higher than a second final crimping height of the electrical conduction portion, wherein a third final crimping height of the transition zone varies between the first final crimping height and the second final crimping height, wherein a difference between first and second final crimping heights is between 0.4 and 0.7 mm, and wherein the third final crimping height of the transition zone varies between 0.4 and 0.7 mm.

2. The method according to claim 1, wherein the crimping zone has a concave first radius of curvature between the electrical conduction portion and the transition zone in a range of 0.1 mm to 0.5 mm.

3. The method according to claim 2, wherein the crimping zone has a convex second radius of curvature between the mechanical retention portion and the transition zone in a range of 0.1 mm to 0.5 mm.

4. The method according to claim 3, wherein a sum of the first radius of curvature and the second radius of curvature is between 0.3 and 0.5 mm.

5. The method according to claim 3, wherein the first radius of curvature is equal to 0.1 mm and the second radius of curvature is equal to 0.2 mm.

6. The method according to claim 1, wherein the difference between the first final crimping height and the second final crimping height is between 0.5 and 0.6 mm.

7. The method according to claim 1, wherein the electrical conduction portion has a length along the longitudinal coupling direction that is greater than or equal to 1.5 mm.

8. The method according to claim 1, wherein the transition zone is between 0.3 mm and 0.6 mm long along the longitudinal coupling direction.

* * * * *